US005922228A

United States Patent [19]

Hall et al.

[11] Patent Number: 5,922,228

[45] Date of Patent: Jul. 13, 1999

[54] HEAT SPACER FOR IRON

[75] Inventors: Stephen M Hall, Cheshire; Peter A Czerner, Monroe, both of Conn.

[73] Assignee: HP Intellectual Corp., Wilmington, Del.

[21] Appl. No.: 08/781,403

[22] Filed: Jan. 10, 1997

[51] Int. Cl.[6] ..... D06F 75/08

[52] U.S. Cl. ..... 219/245; 219/254

[58] Field of Search ..... 219/245, 258, 219/254; 38/74, 77.1–77.83, 82, 88, 89; 16/2.2; 405/408.1, 405.1

[56] References Cited

U.S. PATENT DOCUMENTS

| | | | |
|---|---|---|---|
| 2,928,194 | 3/1960 | Maykemper | 38/77 |
| 4,495,515 | 1/1985 | Pamiello | 357/81 |
| 4,524,263 | 6/1985 | Yamac | 219/249 |
| 4,747,222 | 5/1988 | Riba | 38/77.7 |
| 5,209,621 | 5/1993 | Burbidge | 411/340 |
| 5,279,054 | 1/1994 | Chasen | 219/254 |
| 5,478,984 | 12/1995 | Bouleau et al. | 219/254 |
| 5,623,775 | 4/1997 | Farrington et al. | 38/88 |

FOREIGN PATENT DOCUMENTS

| | | | |
|---|---|---|---|
| 98901 | 8/1924 | Austria | 38/74 |
| 1017946 | 12/1952 | France | 38/77.4 |
| 16 35 405 | 7/1977 | Germany . | |
| 29 07 619 | 9/1979 | Germany . | |
| GM 76 17 215 | 10/1980 | Germany . | |
| 35 13 508 | 10/1986 | Germany . | |
| 59-168899 | 9/1984 | Japan | 38/88 |
| 61-244397 | 10/1986 | Japan | 38/88 |
| 2-111395 | 4/1990 | Japan | 38/77.3 |
| 4-5997 | 1/1992 | Japan | 38/89 |
| 324426 | 11/1957 | Switzerland | 38/77.4 |

*Primary Examiner*—Teresa Walberg
*Assistant Examiner*—Quang Van
*Attorney, Agent, or Firm*—Barry E. Deutsch

[57] ABSTRACT

An iron is provided with heat buffering spacers which vertically set apart component elements in a stacked arrangement. The spacers cause gaps between stacked parts thus allowing for improved air convection through the iron as well as spacing the metallic heated elements from the thermoplastic elements which attach to it to prevent melting.

6 Claims, 5 Drawing Sheets

HEAT SPACER FOR IRON

BACKGROUND OF THE INVENTION

The present invention relates to electric steam irons, and deals more particularly with an improvement in a steam irons whereby the use of spacer members between stacked elements within the iron starting at the soleplate and preceding upwards causes improved air convection therewithin and protects non-metallic component members of the iron from the adverse affects of heat generated by the soleplate and/or transmitted through the metallic connecting screws.

Irons which are presently known require a base steam rate of between 10–20 grams per minute for primary steam generation. For irons which provide a surge function, such systems further must simultaneously support a surge steam rate on the order of 35 grams per minute at a 1200 watt rating. As such, it should be appreciated that the heat generated by the heating element within the sole plate of the iron is intense.

The sole plate of the iron contains the heating element made from a metallic material which is capable of being heated to and withstanding great temperatures. However, other parts of the iron, such as the housing and/or water tank are disposed directly above the heating element, and are not as heat resistant, if at all, to the heat generated by the heating element and therefore must be protected against melting. Additionally, these plastic parts are connected to the base sole plate through elongate metal fasteners or screws. Since the screw head positively engages the plastic parts to effect clamping, it is further necessary to insure that the heat transmitted through the shank of the fastener and about the head of the fastener remains isolated from the plastic material against which it is being maintained. Additionally, it is desirable to provide spacing between the major component parts of the iron which would allow for air convection, and hence cooling to occur between the stacked parts of the iron. This in turn makes the upper part of the iron, specifically, that which is adapted to be held by the user, cooler to hold.

Attempts have been made to isolate non-metal parts of an iron from the heated soleplate. One such attempt is disclosed in Japanese publication No. 404005997 A published on Jan. 9, 1992. However, the iron disclosed in this publication does not employ spacers to effect air convection between plural stacked elements of the iron. The disclosed iron uses no intermediate member, such as a skirt, which would otherwise rest on top of the heated soleplate.

Accordingly, it is an object of the invention to provide an iron of the aforementioned type which connects metallic and non-metallic parts to one another in a plural stacked spaced apart arrangement to effect air convection through gaps between the component parts of the iron.

It is yet a further object of the invention to provide an iron of the aforementioned type wherein successively stacked parts are spaced from one another using a spacer to effect assembly of the iron without the undesirable transmission of heat from metallic heat generating parts to the heat sensitive plastic parts.

Still a further object of the invention is to provide an iron of the aforementioned type wherein a plurality of spacers are used to connect successively stacked parts with one another with each spacer being inserted with the component parts of the iron prior to assembly.

Still a further object of the invention is to provide an iron of the aforementioned type wherein axially paired low thermal conducting spacers are used to connect non-metallic parts to one another.

Further objects and advantages of the invention will become apparent from the following description and the appended claims.

SUMMARY OF THE INVENTION

Figure 1:
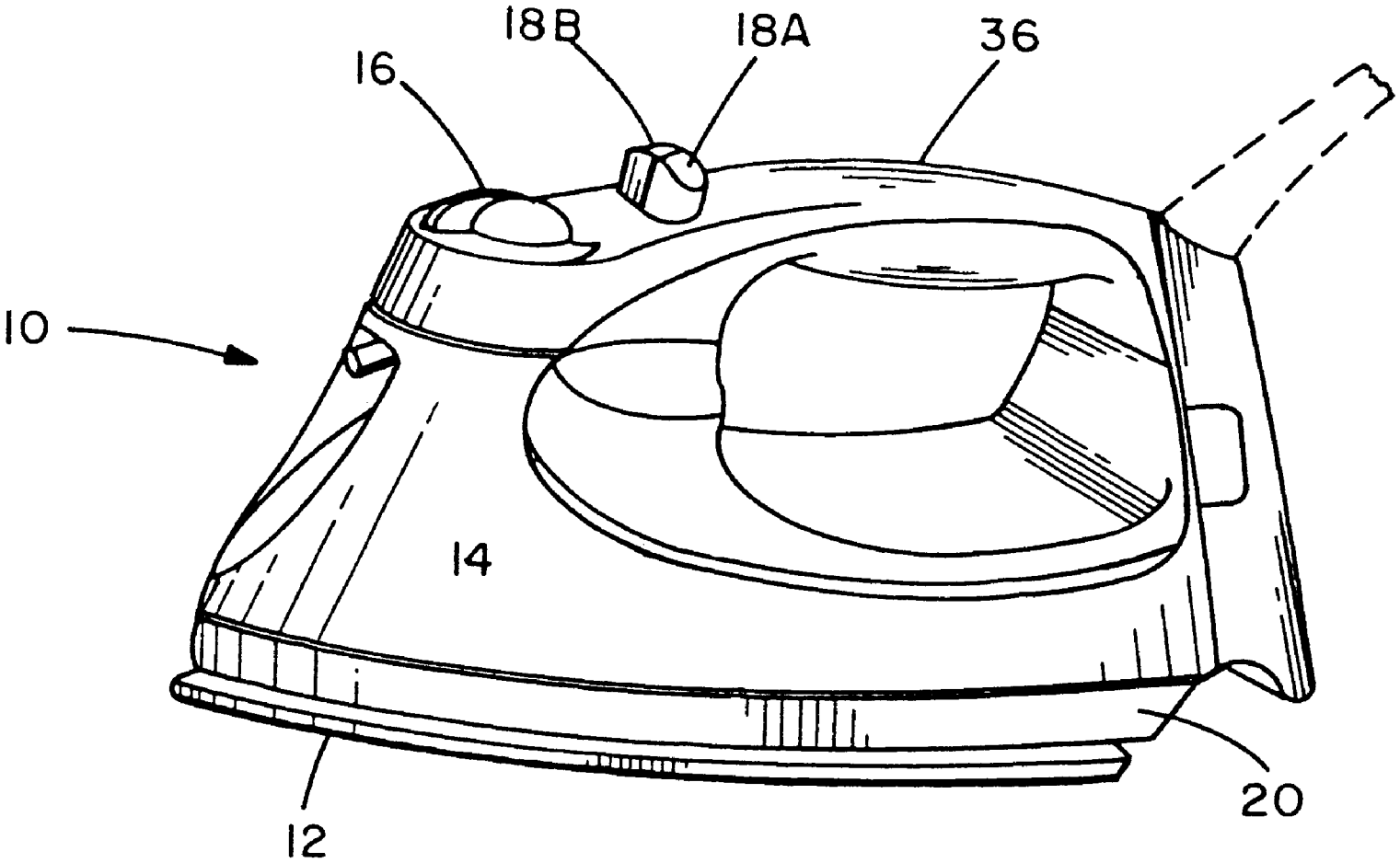
FIG. 1 is a perspective of an iron embodying the invention.

The invention resides in an iron with improved air convection features wherein metal and non-metal parts are stacked one upon the other and aligned openings registered to blind openings in the bottom soleplate are provided in order to receive fasteners therein. Each fastener connects to the top-most stacked part through the intermediary of a spacer.

The invention is found in an iron of the type having a soleplate made of a heat conductive material and a housing connected to the soleplate, and comprises a soleplate having a plurality of threaded openings formed therein and opening towards the housing. At least one generally horizontally disposed intermediate member is substantially superimposed over the soleplate and between the soleplate and the housing. The at least one generally horizontally disposed intermediate member has a plurality of openings each aligned with one of the plurality of threaded upwardly opening openings in the soleplate. A fastener is associated with each of the aligned openings in the housing, in the at least one generally horizontally disposed intermediate member and in the soleplate. At least one spacer having a through passage formed therein is provided and is located within each of the openings in the housing and in the at least one generally horizontally disposed intermediate member, with each of the fasteners being received within an associated passage of each the spacers.

The invention further resides in the fastener being a threaded fastener and having a T-shaped head which captures the spacers associated with the housing to clamp the generally horizontally disposed intermediate member between the housing and the soleplate. Preferably, the number of the threaded openings in the soleplate is three. Usually, the soleplate has a generally triangular shape as defined by a base region and a tip region with the tip region being substantially aligned midway with the base length and coincident with an iron central axis.

Ideally, each of the three openings in the soleplate and the intermediate member are arranged such that two of the plurality of openings are disposed adjacent the base of the soleplate and along either side of the axis of symmetry and the third of the plurality of openings being disposed coincidentally with the axis of symmetry adjacent the tip of the soleplate. In the preferred embodiment, the soleplate is comprised of a metallic casting with a steam chamber cover disposed thereon and the generally horizontally disposed intermediate member being a skirt stacked on top of the steam chamber cover and below the housing. Preferably, the openings in the skirt each have a vertically extending wall of a height sufficient to receive two axially aligned spacers therein and the openings in the housing are formed in outwardly extending tabs integrally molded to the housing.

In the disclosed embodiment, the housing includes a water tank and the water tank is comprised of two separate pieces; a top piece connected to a handle portion of the housing and a bottom tank piece correspondingly shaped to fit with the housing upper part to define a chamber therein. The outwardly extending tabs are integrally molded to the bottom tank piece.

Ideally, each of the spacers has a generally hat-shaped configuration with cylindrically extending wall portions integrally connected with a rim portion of a diameter greater than the wall portion and the vertically extending wall portions of the openings in the skirt and being sized to receive the cylindrically extending wall portion of each spacer and each spacer in each opening being inserted therein with the rim portion outwardly disposed.

The invention further resides in an electric steam iron having a housing for providing a handle, a soleplate with a heating element, a water reservoir and means for depositing water from the reservoir onto the soleplate for causing steam generation wherein the improvement comprises at least one spacer with a passage formed from a non-heat conducting material being disposed between the soleplate and the water reservoir and a fastener disposed through the at least one spacer and connecting the water reservoir and the soleplate and wherein the water reservoir is of a two piece construction defined by an upper piece and a bottom piece, the upper of the pieces defining part of the housing and the lower of the two pieces having means for receiving the at least one spacer.

DETAILED DESCRIPTION OF THE PREFERRED EMBODIMENT

Referring to FIG. 1, there is shown an electric steam iron 10 incorporating the features of the present invention. Although the present invention will be described with reference to the single embodiment shown in the drawings, it should be understood that the present invention may be incorporated into various types of irons and or analogous devices. In addition, any suitable size, shape or type of elements or materials could be used.

Figure 2:
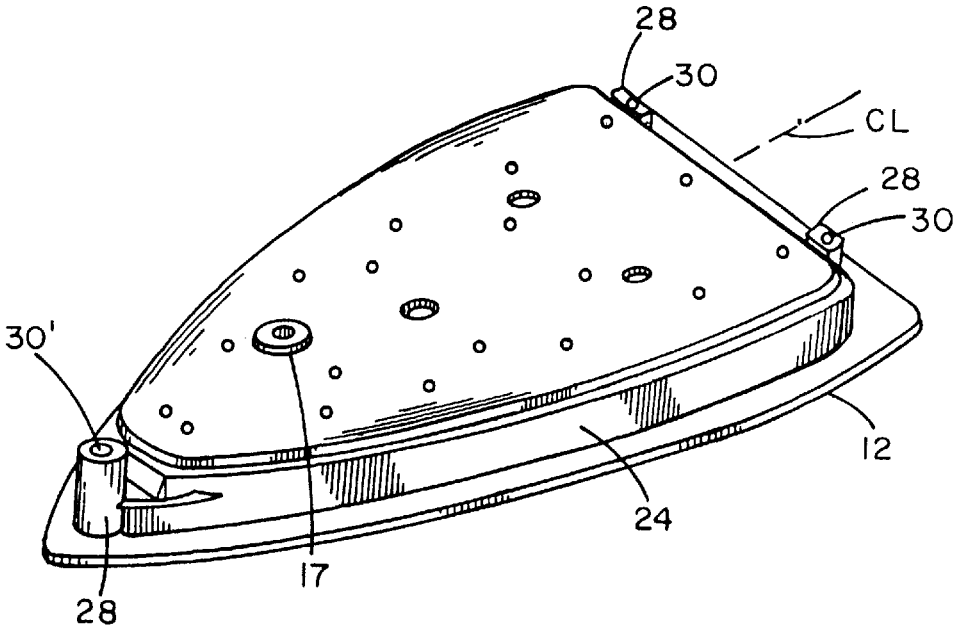
FIG. 2 a top plan perspective view of the front of a soleplate.

The iron 10 generally comprises a soleplate 12 extending symmetrically about a center line CL and defined by a base and a tip disposed concentrically with the centerline CL, a housing 14, a temperature control knob 16 which is articulated to a thermostat boss 17 extending into the steam chamber cover 22. Referring also to FIG. 2, a top plan perspective view of the front of the soleplate 12 is shown. The soleplate 12 has a raised wall 24 extending upwardly in a generally triangular shape that forms sidewalls for the steam chamber 21. The steam chamber cover 22 is attached to the top of the wall 24 to form the top of the steam chamber in accordance with one aspect of the invention.

As best seen in FIG. 2, the soleplate is formed from a metallic casting, and as part of the casting, has a plurality of mounting formations or posts 28,28 into which are formed threaded blind openings 30,30,30' which extend vertically into the formations and open upwardly towards the top of the iron. The arrangement of the threaded openings 30,30 is such that two such openings are located at the rear or base of the triangular shape of the soleplate equidistantly spaced about the bifurcating centerline (CL) with the remaining opening 30' being disposed coincidentally with the centerline (CL) at the tip of the triangular shape.

Figure 3:
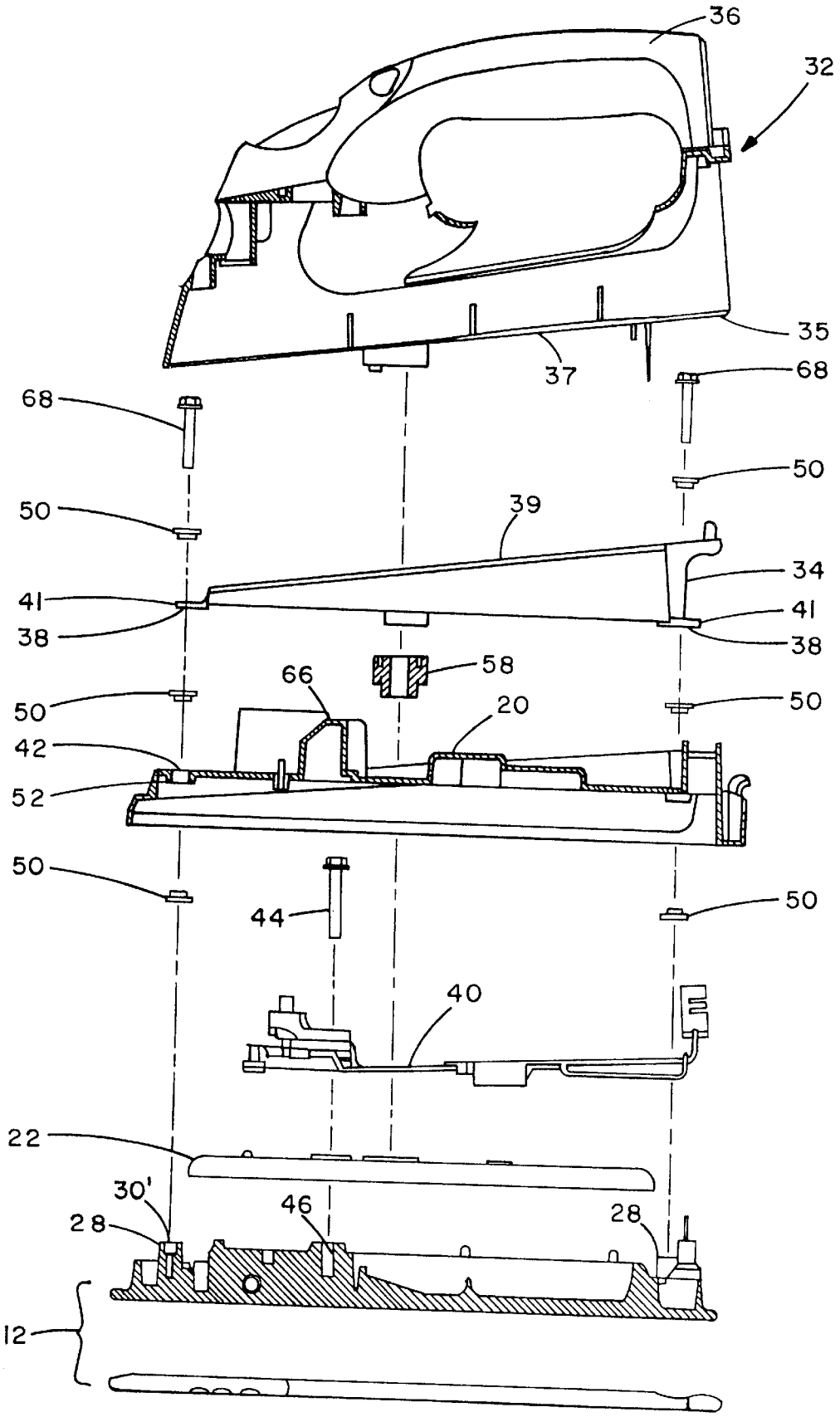
FIG. 3 is an partially fragmentary exploded side elevation view of the iron shown in FIG. 1 showing the stacking arrangement of the various component parts.
Figure 4:
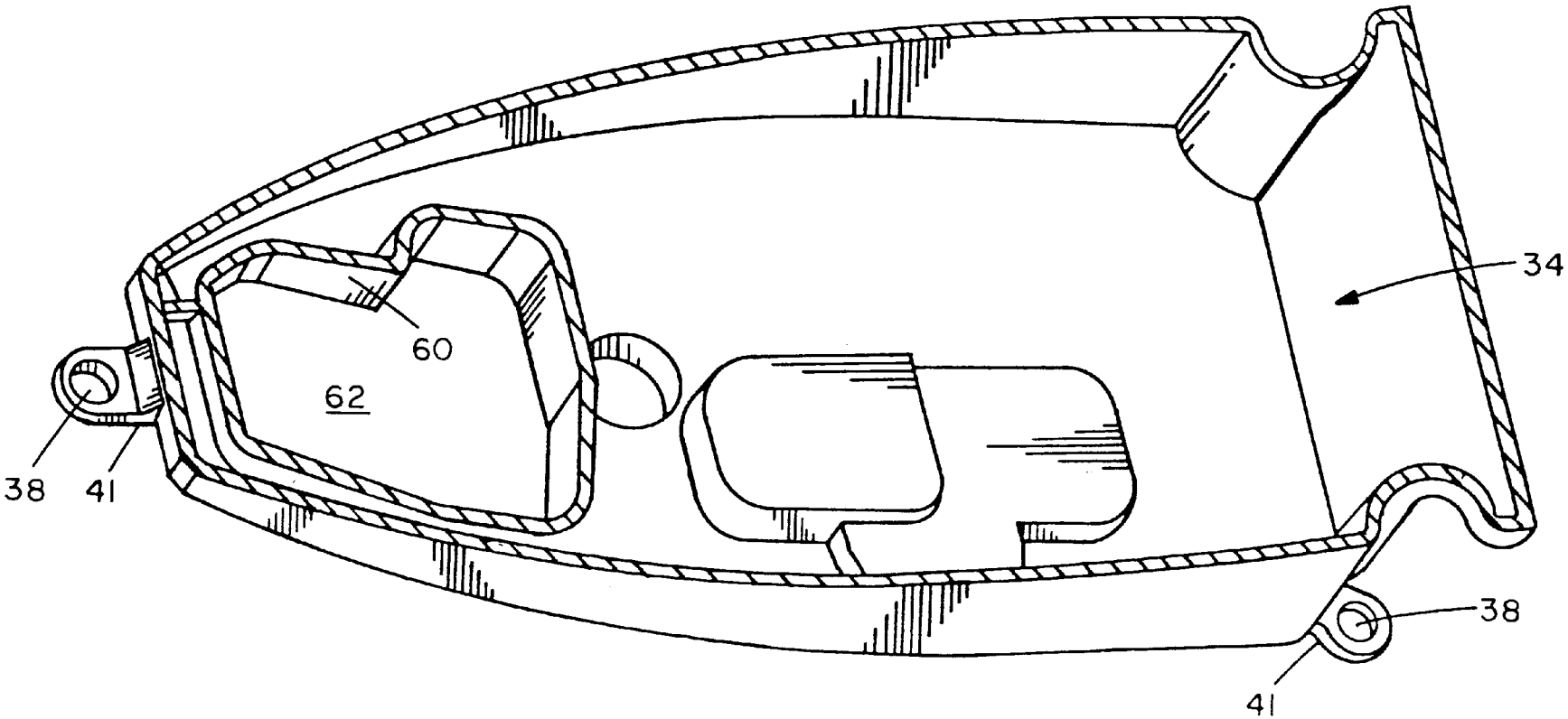
FIG. 4 is a perspective view of the bottom tank piece.
Figure 5:
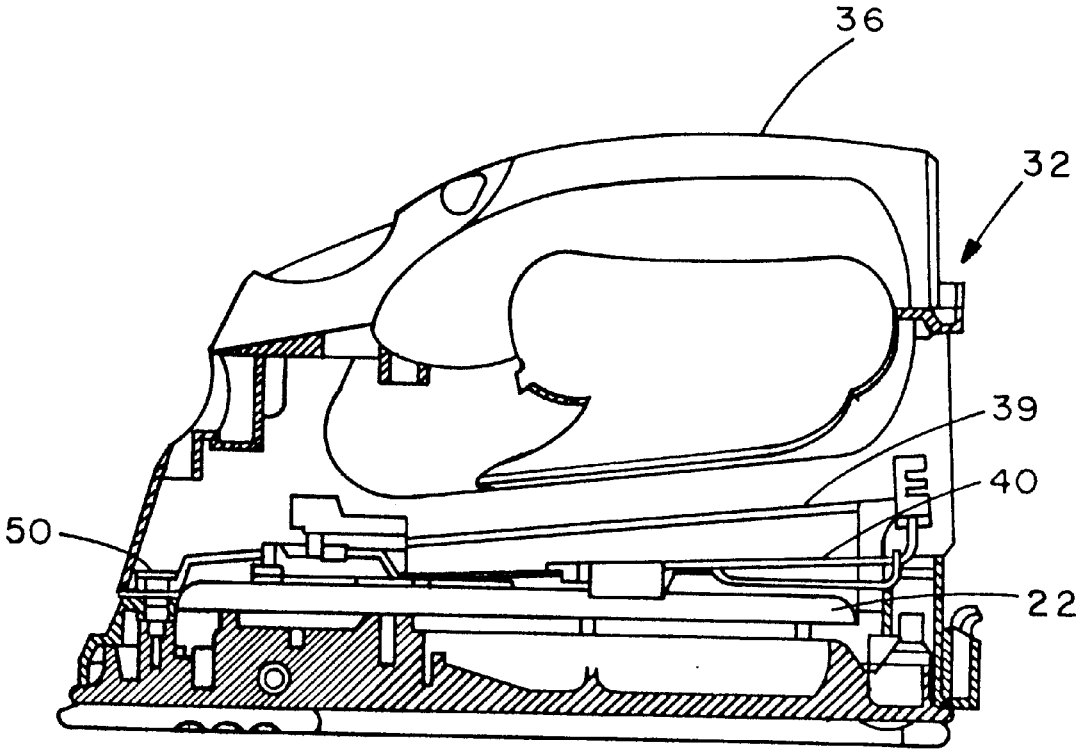
FIG. 5 is a cross-sectional assembly view of the iron.
Figure 6:
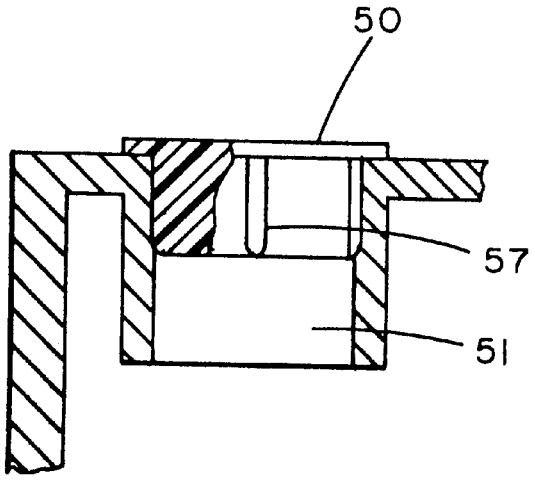
FIG. 6 is an enlarged cross-sectional view of a spacer in assembled relation with the skirt.

Referring now to FIGS. 3 and 4, it should be seen that the housing 14 for purposes of this discussion is in its basic design, a two-part member comprised by an housing upper part 32 and lower part 34. The upper housing part 32 is comprised of a handle 36, the mounts for surge buttons **18*a* and spray button 18*b***, as well as other elements which are not the subject of the present application.

The housing upper part 32 includes the housing 14 which covers the internal components of the part 32, such as the thermostat, gear valve assembly and control lever linkages. In addition, the housing upper part includes an upper tank piece 35 which is connected to the housing 14 by screws or the like. The lower housing part 34 is comprised of a lower mating tank piece, and therefore will hereinafter be referred to as the lower tank piece. The upper tank piece 35 has a continuous lower edge 37 which is correspondingly sized and shaped to mate with a mating continuous upper edge 39 of a lower tank piece 34. The upper and lower tank pieces are made from a plastic material and are fixedly connected to one another through a heat weld which is made between the mating upper and lower edges 37 and 39.

The lower tank piece 34 as best illustrated in FIG. 2, has three openings 38,38,38 disposed about its periphery and which openings are located thereon so as to be in alignment with the blind threaded openings 30,30,30' formed in the soleplate 12 when the housing upper part 32 is superimposed thereover. Each of the three openings 38,38,38 is formed in an outwardly extending tab 41 integrally molded with the lower tank piece 34.

As best illustrated in FIG. 3, disposed beneath the lower tank part 34 is a skirt 20 which likewise has a generally triangular shape and fits about the border of the soleplate in the manner indicated in FIG. 1. The skirt 20 likewise has three openings 42,42,42 formed thereabout which are co-aligned with like openings formed in the soleplate 12 and in the base of the lower tank piece 34. Interposed between the lower surface of the skirt 20 and the top surface of the steam chamber cover 22 are the electrical component means 40 for the iron, e.g., switches and the like, responsible for the on and off conditions of the iron. The electrical component means 40 are held in place via a locating screw 44 which is received within a mounting opening 46 in the soleplate.

In accordance with the invention, a plurality of spacers 50, 50 each having a passage 51 formed therethrough are provided as part of the iron design and are provided for fitting within the openings 42,42,42 formed in the skirt 20, and within the openings 38,38,38 in the tank lower piece 34. The three openings in the skirt have a slight vertically extending cylindrical wall 52 which is of a dimension sufficient to receive a correspondingly shaped cylindrical portion 54 of each of the spacers axially aligned with one another within each opening 42,42,42. That is, each spacer 50,50 has a generally hat-shaped configuration as defined by a generally annular rim portion 56 having an outer diameter which is larger in diameter than the cylindrical portion 54, but is slightly smaller in size than the inner diameter of each of the cylindrical openings 42,42,42 in the skirt 20.

Similarly, the openings 38,38 formed in the lower tank part 34, each receive one of the spacers 50,50 such that each spacer is located bottom side down such that the rim portion thereof 56,56 acts against the top surface of the tabs 41,41 defining the openings in the part 34. The skirt member is assembled onto the soleplate by positioning it over the steam chamber cover 22 with the electronic component means 40 secured thereto in the manner discussed above.

Thereafter, with the spacers maintained in place, the skirt 20 is assembled onto the soleplate and other components such as a steam valve 58 is positioned onto the skirt top surface. The lower tank piece 34 is adapted to accommodate the stacked arrangement of parts in that, for example, it is provided with an isolation wall 60 defining an opening 62 for receiving an upwardly extending profile 66 of the skirt 20.

Each of the set of three openings 42,42,42, 38,38,38 and 30,30,30' is aligned with a corresponding one in the other sets and a fastener 68, preferably a T-shaped screw, is inserted through the co-aligned openings and threadedly engages with one of the threaded openings 30,30,30' in the soleplate. These fasteners are thereafter tightened down to clamp the stacked members above one another and yet still provide gaps therebetween. It should be understood that the spacing of the skirt 12 and the soleplate and the spacing of the soleplate from the bottom tank piece 34 effects improved air convection through the iron and further thermally isolates the heated metallic parts of the soleplate thereby preventing heat transferred through the metallic screws from melting the plastic material making up the skirt 20 and the tank lower piece 34.

Figure 5A:
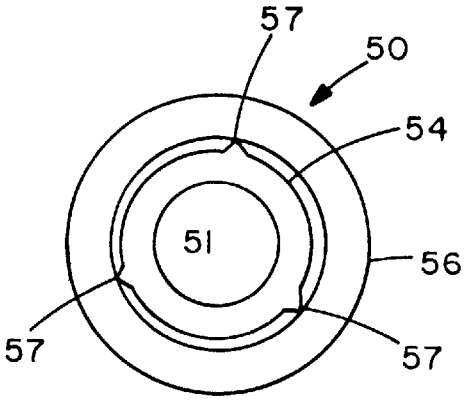
FIG. 5*a* is a top plan view of the a heat spacer.
Figure 5B:
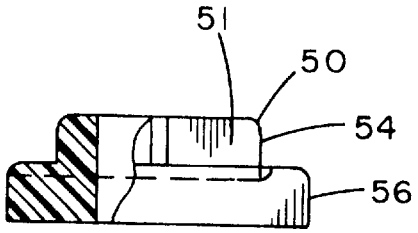
FIG. 5*b* is a side elevation view of the heat spacer shown in FIG. 5*a*.

Referring now to FIGS. 5*a* and 5*b*, it should be seen that each spacer 50 has a plurality of vertically extending ribs 57 which extends parallel to the passage 51 therein and extend radially outwardly thereof ending in a pointed projection. Each rib extends radially outwardly a dimension slightly greater than the inner diameter of each of the openings 38,38,38 and 42,42,42 carried by the tank lower piece 34 and by the skirt 20, respectively. Thus, the ribs deform when inserted within these openings so as to maintain the spacers in an interference fit therewithin. This further aids in the assembly process by causing each of the spacers to be located within the openings without them dropping out, especially in the opposed double axial application of the spacers in the openings 42,42,42 of the skirt. The spacers can be made from any thermal buffering material, but in the preferred embodiment each is made from thermoset and/or thermoplastic material.

It should be understood that the foregoing description is only illustrative of the invention. Various alternatives and modifications can be devised by those skilled in the art without departing from the spirit of the invention. Accordingly, the present invention is intended to embrace all such alternatives, modifications, and variances which fall within the scope of the appended claims.

What is claimed is:

1. An electric iron of the type having a soleplate made of a metal material and a housing having a plurality of openings connected to the soleplate comprising:

said soleplate having a plurality of threaded openings formed therein and opening towards said housing and aligned with the said housing openings;

said housing comprising an upper housing member and a lower housing member, said housing openings being formed in said lower housing member;

a skirt connected to said lower housing member and formed from plastic material, said skirt having a plurality of openings aligned with said housing openings and said soleplate openings;

a fastener associated with each of said aligned openings in said housing, in said skirt, and in said soleplate; and at least one thermal buffering spacer having a through passage formed therein and being located within each of said openings in each fastener, extending through a respective spacer passage, each of the openings formed in said skirt having two axially aligned spacers located therein, each of said spacers including an enlarged head, the enlarged head of each of a first group of spacers located in the openings formed in the skirt engaging an upper surface of the skirt and each of the enlarged heads of a second group of the spacers located in the skirt openings engaging a lower surface of said skirt, said first and second groups of spacers sandwiching the skirt therebetween to hold the skirt in a vertical position relative to the soleplate.

2. An iron as defined in claim 1 characterized by the number of said threaded openings in said soleplate being three.

3. An iron as defined in claim 2 further characterized by said soleplate having a generally triangular shape as defined by a base region and a tip region, with the tip region being substantially aligned midway a base length and coincidents with an iron central axis.

4. An iron as defined in claim 3 further characterized by said openings in said housing being formed in outwardly extending tabs integrally molded to the lower housing member.

5. An iron as defined in claim 4 further characterized in that said lower housing member includes a water tank.

6. An iron as defined in claim 5 further characterized in that said skirt openings have vertically extending cylindrical walls, and each of said spacers located within said openings has a vertically extending cylindrical wall sized to be received within the vertically extending cylindrical wall of the skirt.

* * * * *